United States Patent [19]

Mansour

[11] Patent Number: 5,023,522

[45] Date of Patent: Jun. 11, 1991

[54] DIMMER FOR TABLE LAMPS

[76] Inventor: George A. Mansour, 15 Blacktoff Dr., Scarborough, Ontario, Canada

[21] Appl. No.: 336,137

[22] Filed: Apr. 11, 1989

[30] Foreign Application Priority Data

Apr. 13, 1988 [CA] Canada ..... 564079

[51] Int. Cl.[5] ..... F21S 1/12

[52] U.S. Cl. ..... 315/291; 362/395

[58] Field of Search ..... 362/411, 801, 362, 368, 362/394, 382, 395; 323/905; 315/291, 282, 298

[56] References Cited

U.S. PATENT DOCUMENTS

| | | | |
|---|---|---|---|
| 2,014,054 | 9/1935 | Rood et al. | 362/411 |
| 2,715,197 | 2/1954 | Dubroff et al. | 315/282 |
| 2,884,514 | 4/1959 | Boiteux | 323/905 |
| 3,147,928 | 9/1964 | Carpenter | 323/905 |
| 3,184,618 | 3/1961 | Laitinen | 323/905 |
| 3,523,212 | 2/1968 | Murphey | 315/291 |
| 4,284,925 | 8/1981 | Bessone et al. | 315/240 |
| 4,584,519 | 4/1986 | Gruodis et al. | 323/245 |
| 4,668,876 | 5/1987 | Skarman | 307/116 |

*Primary Examiner*—Eugene R. LaRoche
*Assistant Examiner*—Ali Neyzari

[57] ABSTRACT

A dimmer for use as a support for a lamp and having a housing body, a chamber within the housing body, a dimmer switch within the housing body and a switch operating member extending outwardly through an opening in the body, the body supporting the lamp, and an opening in the body for receiving a cord from the lamp, and a receptacle connected to the dimmer switch for receiving a plug on the cord.

3 Claims, 3 Drawing Sheets

DIMMER FOR TABLE LAMPS

The invention relates to a dimmer for lamps, which is incorporated in a housing or stand which may be used to support the lamp.

Lamps such as table lamps usually have an "on/off" switch so that the light is simply on or off.

In some cases the table light or standard light may be provided with a three-position switch. However in this type of lamp, a special bulb must be provided with three filaments, and the results are not always satisfactory.

It is however well known that many people wish to control the level of illumination. Dimmer switches are well known, for installation in the wall, for controlling the level of overhead lighting.

It is possible to incorporate such a dimmer switch or brightness control in a table lamp itself. One proposal is shown in U.S. Pat. No. 2,715,197 dated Aug. 9th 1955. In practice, however, this has not been done to any great extent.

Possibly this is due to the fact that the design of table lamps varies widely. In many designs of table lamps there would be no space to incorporate a dimmer switch, in the manner shown in the Patent.

Another proposal has been to incorporate a separate switch in the electrical cord, which was provided with a dimmer control. One such proposal is shown in U.S. Pat. No. 3,184,618. This proposal is an attractive one, but in practice, the purchaser of the table lamp will be obliged to modify the cord so as to incorporate the dimmer switch. Many purchases would be either unwilling or unable to do this.

The third alternative is to have the electrical receptacles in a room wired through a dimmer switch. This however requires the services of an electrician. In addition, the typical dimmer switch is usually of restricted power capacity, and consequently would not be able to handle more than two or three lamps.

In addition, however, even if this proposal was adopted, all of the lamps would switch on and off, and be dimmmed simultaneously. This might not be desirable from the view point of the purchaser.

With a view, therefore, to overcoming these various problems, the invention comprises a dimmer for lamps having a housing body defining a planar front surface, and side or edge portions, a chamber defined within said housing body, a dimmer switch in said housing body, and a manual switch operating means having a portion extending to the exterior of one edge of said housing body for operation thereof, electrical connection means connected to said dimmer switch for connecting same to a power receptable, an electrical receptacle means within said body connected to said dimmer switch, and opening means in said body whereby an electrical cord from a lamp may be inserted within said body, and connected to said receptacle, said chamber receiving said cord for storing.

More particularly, it is an objective of the invention to provide such a dimmer, wherein said dimmer switch and said receptacle are associated together as an integral structure.

More particularly, it is an objective of the invention to provide such a dimmer having the foregoing advantages wherein said manual control means comprise a rotatable shaft extending from said dimmer switch within said chamber, and a manual control disc on said shaft, accessible from the exterior of an edge of said body.

More particularly, it is an objective of the invention to provide such a dimmer incorporating closure means for closing said chamber, to retain said lamp cord therein.

It is a related objective of the invention to provide a dimmer switch and housing having a face, and edges, and with a portion of a switch control accessible at one of said edges of said housing.

The various features of novelty which characterize the invention are pointed out with more particularly in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

Figure 1:
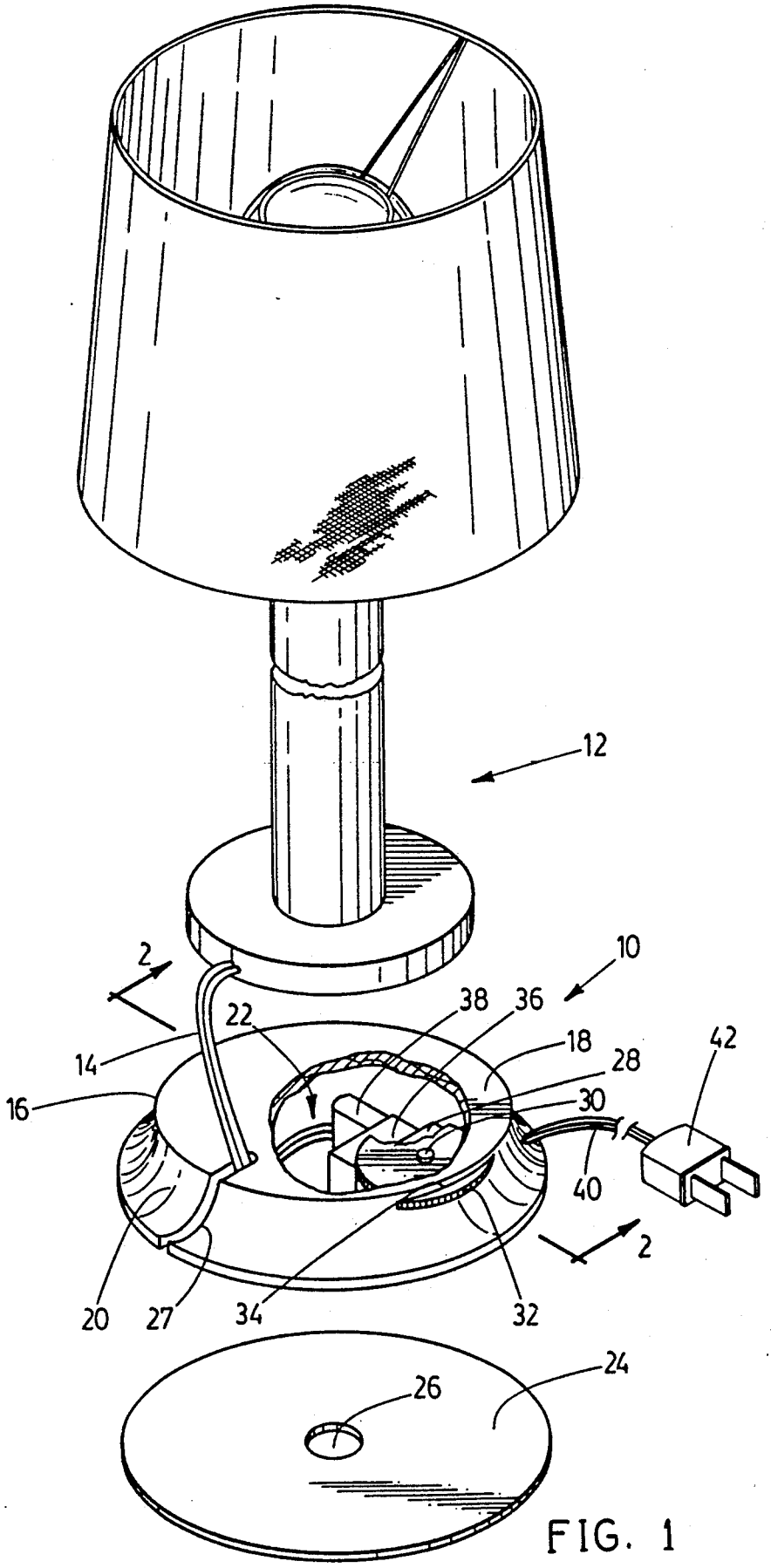
FIG. 1 is an exploded perspective illustration of a dimmer in accordance with the invention, showing a table lamp associated therewith.

Referrring first of all of FIG. 1, it will be seen that the invention is illustrated here in an embodiment of a dimmer indicated generally as 10, which is adapted to be associated with a typical table lamp indicated as 12. The table lamp 12 will have a typical electrical cord 14, by means of which it may have been plugged into, for example, a wall receptacle, extension cord, or other source of electrical power (not shown) such as is well known in the art.

The dimmer 10 in this embodiment comprises a body or housing 16 having a planar front or top surface 18, adapted to be placed under, and support the base of the table lamp 12, and side or edge portions 20.

Figure 2:
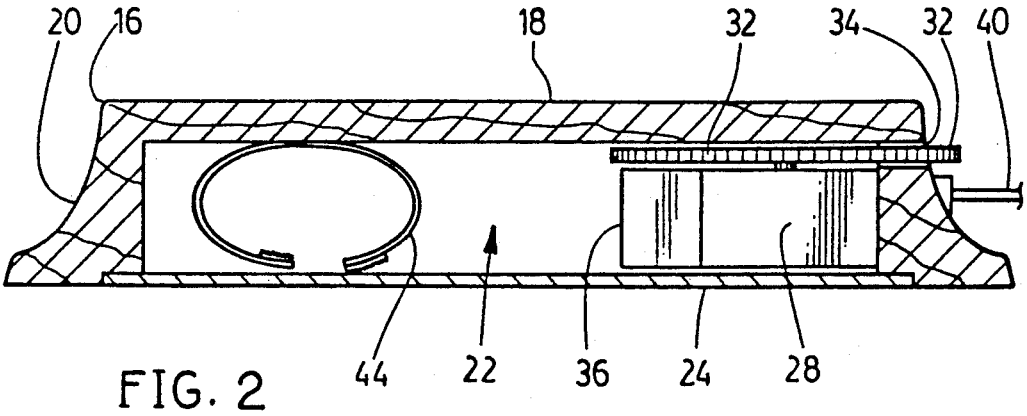
FIG. 2 is a section along the line 2—2 of FIG. 1.
Figure 3:
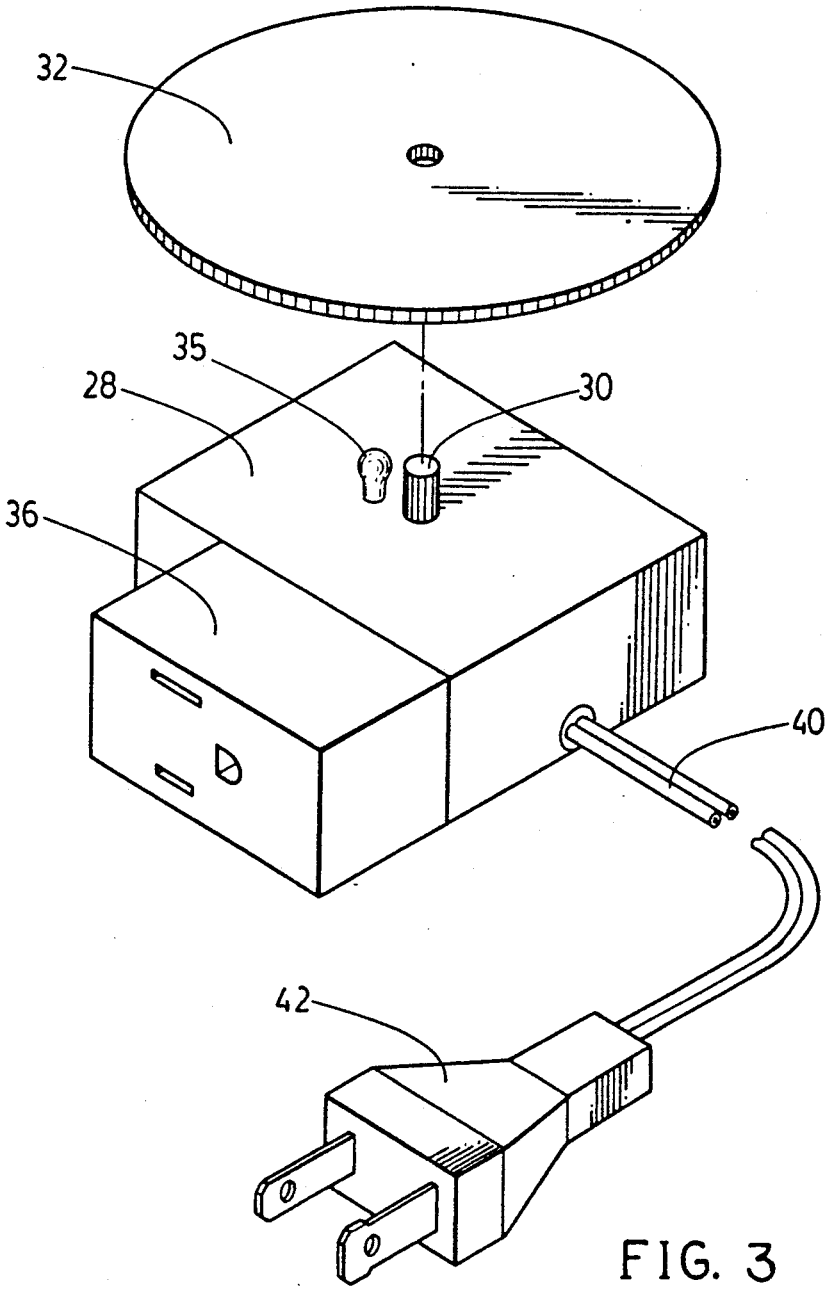
FIG. 3 is a perspective illustration of the dimmer switch and receptacle.

As shown in FIG. 2, the stand body or housing is hollow and defines a chamber 22, which in this embodiment is located beneath the front or top surface 18. In this embodiment of the invention, a closure panel 24, which may make a friction fit within side portions 20, is provided. Although this will not always be necessary, closure panel 24 may have any suitable means such as a finger opening 26 by means of which it may be removed.

An opening 27 in side portion 20 of stand body is provided, for giving access to cord 14 from lamp 12. Illustrated simply within the chamber 22, there is located a dimmer switch 28. Dimmer switches are available from various manufacturers, and accordingly the details of the construction of the switch are omitted for the sake of clarity.

In this particular example, it has an operating shaft 30, which typically will be rotated by a manual control means. In this case, the control consists of the flat disc 32. Disc 32 is of suitable size to extend through a slot 34 in an edge or side portion 20 of stand body 16.

Only a portion of the disc extends through the slot, and is accessible only at that portion of the edge of the housing. The front or top face of the housing is thus left unobstructed.

The shaft is thus operated from a point displaced to one side only of its axis which, in this case, will normally be vertical.

A small bulb 35 is incorporated in dimmer switch 28, beneath disc 32. Disc 32 is of transparent or translucent material, and the bulb 35 provides a degree of illumination for disc 32. Bulb 35 is powered through wiring (not shown) in dimmer switch 28.

It will be appreciated that it may be desirable in some cases to mount the housing 10, containing the dimmer switch, on a wall or elsewhere, remote from the lamp. This is an option which may have some appeal to some consumers.

In addition, the invention is not solely restricted to a dimmer switch 28 operated by means of a shaft 30, but will equally be applicable to dimmer switches operated in other ways.

Associated with the dimmer switch 28 is an electrical receptable 36. Electrical receptacle 36 is adapted to receive a plug 38 (FIG. 4) on the cord 14 of the table lamp 12.

Dimmer switch 28 is, in turn, provided with a cord 40 having a plug 42 by means of which the dimmer switch may be plugged into a source of electrical power such as a wall receptacle, extension cord or the like, the details of which are omitted for the sake of clarity.

For the sake of convenience, although not an essential feature, some form of retaining strap 44 may optionally be provided in chamber 22, typically having VELCRO (trademark) fastenings or the like, by means of which the surplus length of electrical cord 14 can simply be coiled up and fastened in position.

Figure 4:
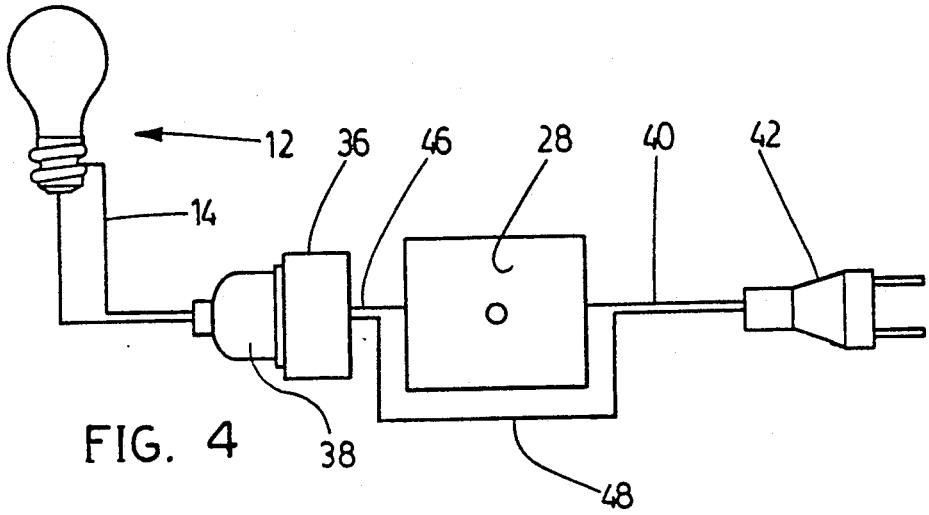
FIG. 4 is a schematic circuit diagram.

As best shown in FIG. 4, the typical electrical connections are shown. The cord 14 is plugged into the receptacle 36. The receptacle 36 is connected by wire 46 to the dimmer switch 28. Typically the wire 48 will simply be a connection directly through to cord 40. Typically wire 48 will be incorporated within the dimmer switch 28, although it is illustrated exteriorly in FIG. 4 simply for the sake of clarity.

In addition, it will of cource be appreciated that in a typical case, the receptacle 36 and dimmer switch 28 will be formed as an integral structure as shown, and the wires 46 and 48 will all be internal.

In operation, the cord 14 of a table lamp is led through opening 26 into chamber 22. The plug 38 is plugged into the receptacle 36. The plug 42 is plugged into a source of electrical power.

The cord 14 is stored inside the chamber. The table lamp may be placed on top of the surface 18 if desired.

If the lamp 12 has no switch of its own, then the dimmer switch can be used to switch it on and off, and to control its brightness.

If the lamp 12 has a switch, that switch will simply be left switched on. The lamp can be switched on and off, and the brightness controlled by means simply of the dimmer switch 28 and the control knob 32.

Typically, the housing or body will be formed of aesthetically pleasing material, and with a variety of different designs to suit different decor. Wood, metal and synthetic plastics may all be used for the purpose.

It will also be appreciated that while the invention has been described in relation to its uses as a table lamp, it may also equally well be used as a lamp hung on a vertical surface such as a wall.

Figure 5:
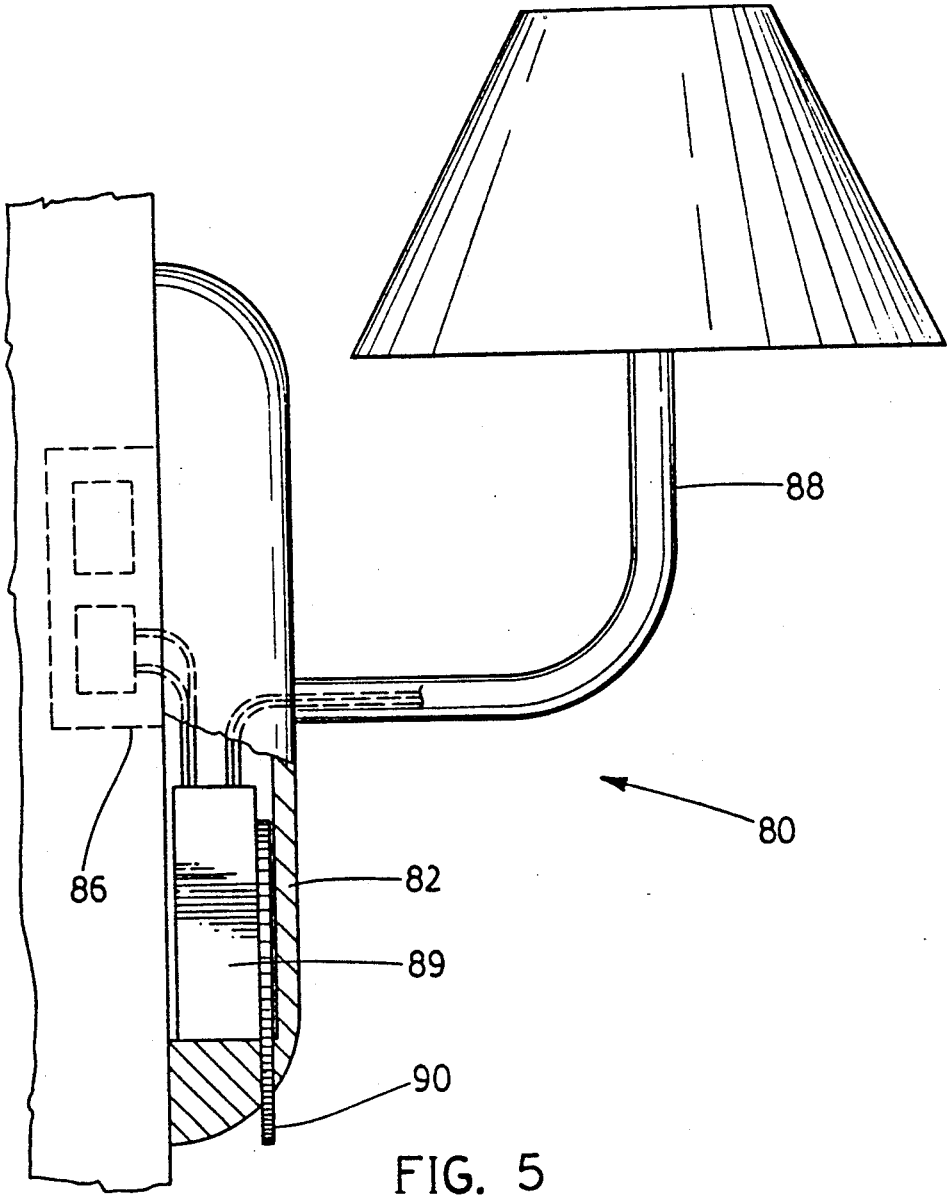
FIG. 5 is a side elevation of an alternate embodiment.

As shown in FIG. 5, such a wall lamp is indicated as 80, having a base 82, typically provided with some form of engagement means (not shown), by means of which it may be attached to a wall. A cord may extend downwardly from the base and plug into a receptacle (not shown). Alternatively however, an electrical outlet 86 can be installed within the wall itself, and the base simply fastened over the outlet, also in a manner well known in the art.

A lamp 88 will be supported on the base 82. The base 82 will contain a dimmer switch 89 with a dimmer control knob 90 of flat disk shape which extends out through a slot in a side edge of the base. In this way the front or top surface of the base may have a clean attractive appearance, and may be decorated in any suitable manner, and the dimmer switch can be operated by means of the unobtrusive knob 90.

The foregoing is a description of a preferred embodiment of the invention which is given here by way of example only. The invention is not to be taken as limited to any of the specific features as described, but comprehends all variations thereof as come within the scope of the appended claims.

What is claimed is:

1. A dimmer for lighting devices, for use as a stand for a lighting device having an electrical cord and plug and comprising;

a housing body defining a planer lighting device supporting surface and edge portions;

a chamber defined within said housing body;

a dimmer switch in said housing body, a manual control means comprising a rotatable shaft extending from said dimmer switch within said chamber, and a manual control on shaft, a portion of said control being accesible from the exterior of said body, electrical receptacle means within said body connected to said dimmer switch opening means in said body whereby said electrical cord from said lighting device may be inserted within said body and said plug inserted into said receptacle means;

a storage enclosure in said chamber for receiving said cord for storing of same in said chamber, and, means for connecting said dimmer to a source of electrical power.

2. A dimmer as claimed in claim 1 and including, closure means for closing said chamber, to retain said cord therein.

3. A dimmer as claimed in claim 1 including bulb means associated with said dimmer switch, and wherein said manual switch control means comprises a generally translucent member, said bulb means illuminating said manual switch control means.

* * * * *